United States Patent [19]

Tsai

[11] Patent Number: 4,955,751

[45] Date of Patent: Sep. 11, 1990

[54] CROSSROAD WITHOUT TRAFFIC LIGHTS

[76] Inventor: John Tsai, No. 3, Lane 541, Fu Hsing Rd., Hsi Tun Chu, Taichung City, Taiwan

[21] Appl. No.: 396,861

[22] Filed: Aug. 22, 1989

[51] Int. Cl.[5] ..... E01C 1/00

[52] U.S. Cl. ..... 404/1; 405/132; 52/175

[58] Field of Search ..... 404/1

[56] References Cited

U.S. PATENT DOCUMENTS 1,173,505 2/1916 Hale ..... 404/1

2,642,788 4/1948 Andrews ..... 404/1

3,394,638 3/1966 Burrell ..... 404/1

*Primary Examiner*—Jerome W. Massie

*Assistant Examiner*—Roger J. Schoeppel

*Attorney, Agent, or Firm*—Bernard P. Gans

[57] ABSTRACT

A crossroad includes two roads intersected with each other. One of the roads is level and straight, and the other road is provided with a pair of second dimensional passages, such as tunnels, subways or elevated roadways, each with a respective bypass merging into one side thereof. The entrance of each passage is provided adjacent to and a short distance from the level road. The exit of each passage is provided adjacent to the opposite side of the level road.

4 Claims, 3 Drawing Sheets

CROSSROAD WITHOUT TRAFFIC LIGHTS

FIELD OF THE INVENTION

The present invention relates to a crossroad, and more particularly to a crossroad where no traffic lights are required.

BACKGROUND OF THE INVENTION

Major crossroads are usually controlled by traffic lights. Vehicles are required to stop on the red light, and are free to go on the green light. Frequent stops not only waste time, but also waste fuel due to excess fuel being injected into the engine when accelerating, from rest when the vehicle starts again on the green light. The fuel is not burned completely which causes air pollution. In addition, traffic accidents occur frequently at crossroads.

The present invention has arisen to mitigate and/or obviate the afore-described disadvantages of the conventional crossroad.

SUMMARY OF THE INVENTION

The primary object of the present invention is to provide a crossroad where no traffic lights are required to control the flow of the vehicles.

Another object of the present invention is to provide a crossroad where vehicles can either drive straight through or turn without having to stop at any time.

The present invention relates to a crossroad that has two roads intersecting with each other. One of the roads is level and straight and the other road is provided with a pair of second dimensional passages, such as tunnels, subways or elevated roadways, each with a respective bypass merging into one side thereof. The entrance of each passage is provided adjacent to, and a short distance away from the level road. The exit of each passage is provided adjacent to the opposite side of the level road.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
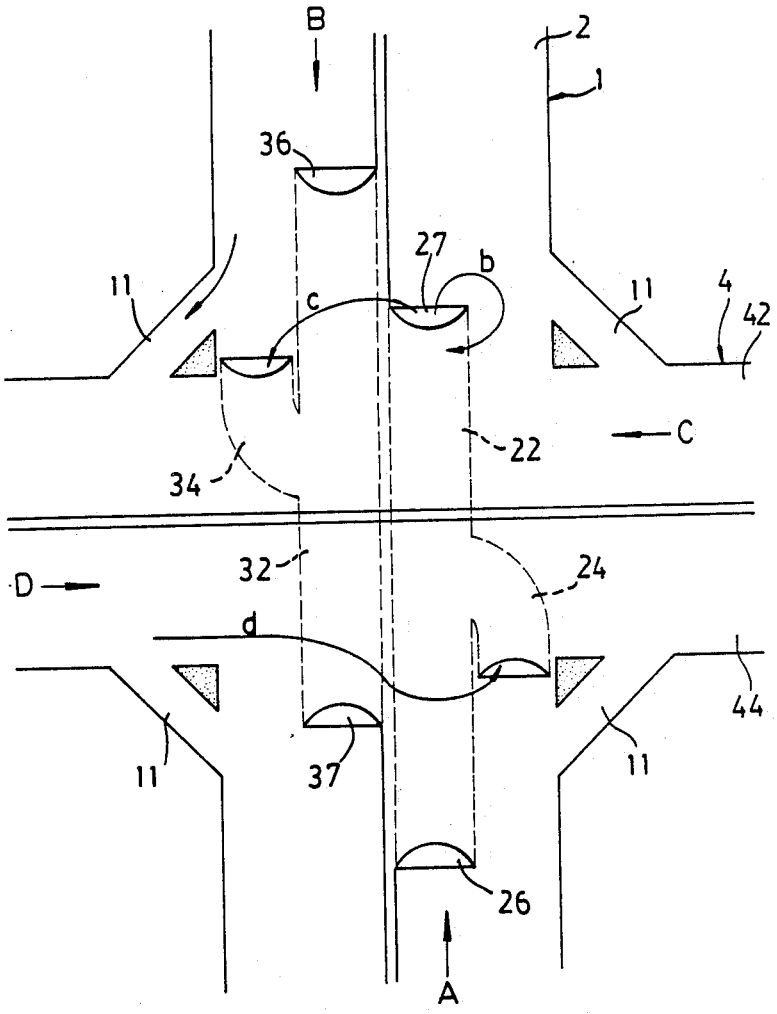
FIG. 1 is a top elevational view of a crossroad in accordance with the present invention.

Referring to the drawings and initially to FIG. 1, the crossroad in accordance with the present invention comprises generally two main roads 1 and 4 intersected with each other. Each main road 1 and 4 comprises two parallel but opposite roadways, 2 and 3, and 42 and 44, respectively. In the illustrated example of FIG. 1, the vehicles keep on the right side of the road. Diagonal driveways 11 are provided on the corners of the connections of the two main roads 1 and 4 so that the vehicles moving on the main roads 1 and 4 can turn right easily.

The main road 4 is level and straight. Vehicles driving on the main road 4 can drive straight through the crossroad without having to stop. Second dimensional passages, such as subways or tunnels 22 and 32, as illustrated in FIG. 1, each with a respective bypass tunnel 24 and 34 are respectively provided on the roadways 2 and 3 of the main road 1. The slopes at both ends of the tunnels 22 and 32 are small; i.e., the ramps at both ends of the tunnels 22 and 32 are gently inclined. The entrances 26, 36 of the respective tunnels 22, 32 are positioned a short distance before reaching the driveway 11. The exits 27, 37 of the respective tunnels 22, 32 are positioned adjacent to the main road 4. It is to be noted that the entrances 26, 36 are positioned a short distance away from main road 4 and are further than the respective exits 37, 27 at the opposite roadways. The bypass tunnels 24, 34 respectively merge into the tunnels 22, 32 from the right side thereof. The entrances of the bypass tunnels 24, 34 are positioned to open right beside the main road 4. An elevated overpass (not shown) may further be provided for pedestrians.

The vehicles (A, B, C, D) can drive straight through the crossroad without having to stop. To turn left, the vehicle (A) follows either the arrow (a) across the top of the tunnel 32 or the arrow (b) to merge into the roadway 42; the vehicle (D) follows the arrow (d) to enter into the bypass tunnel 24 so as to merge into the tunnel 22. To do a U-turn, the vehicle (A) follows the arrow (c) across top of the tunnel 32 and enters into the bypass tunnel 34 to merge into the tunnel 32; the vehicle (D) follows the arrow (d) to enter the bypass tunnel 24 and merge into the tunnel 22, then follows the arrow (a) to merge into the roadway 42. The movements of the vehicles (B and C) are respectively similar to that of the vehicles (A and D). Therefore, the vehicles (A, B, C, D) can freely drive straight through, turn or make a U-turn without having to stop.

Figure 2:
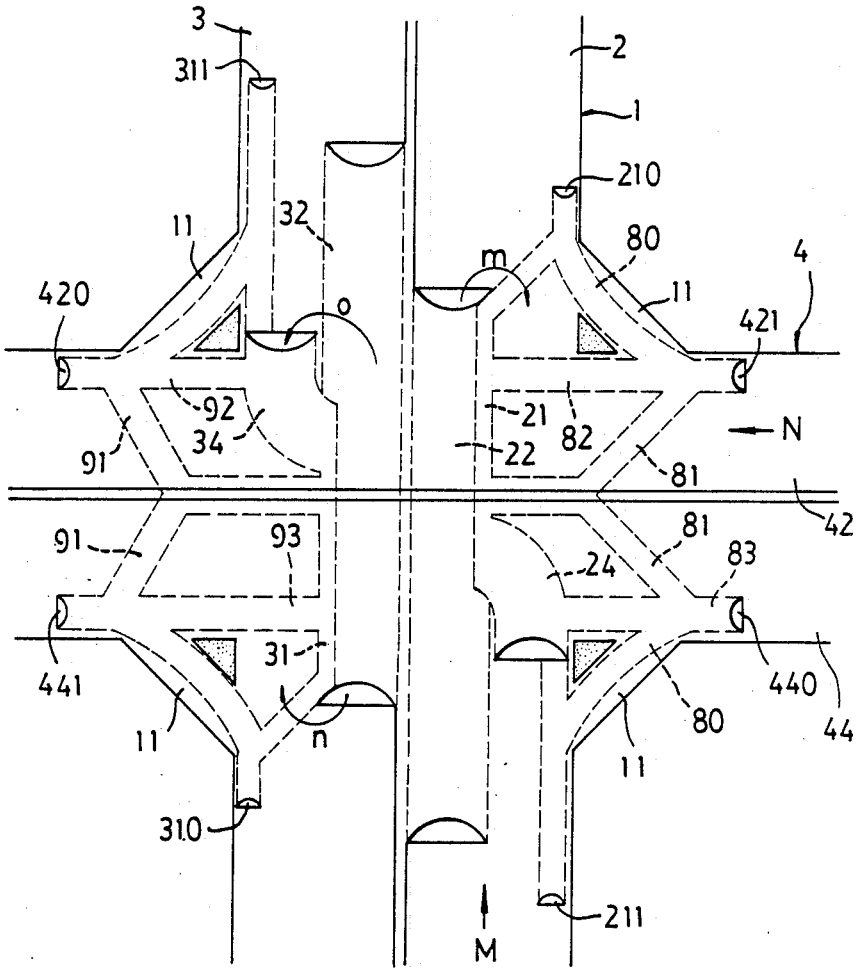
FIG. 2 is a top elevational view of a crossroad similar to FIG. 1, illustrating another embodiment in accordance with the present invention.
Figure 3:
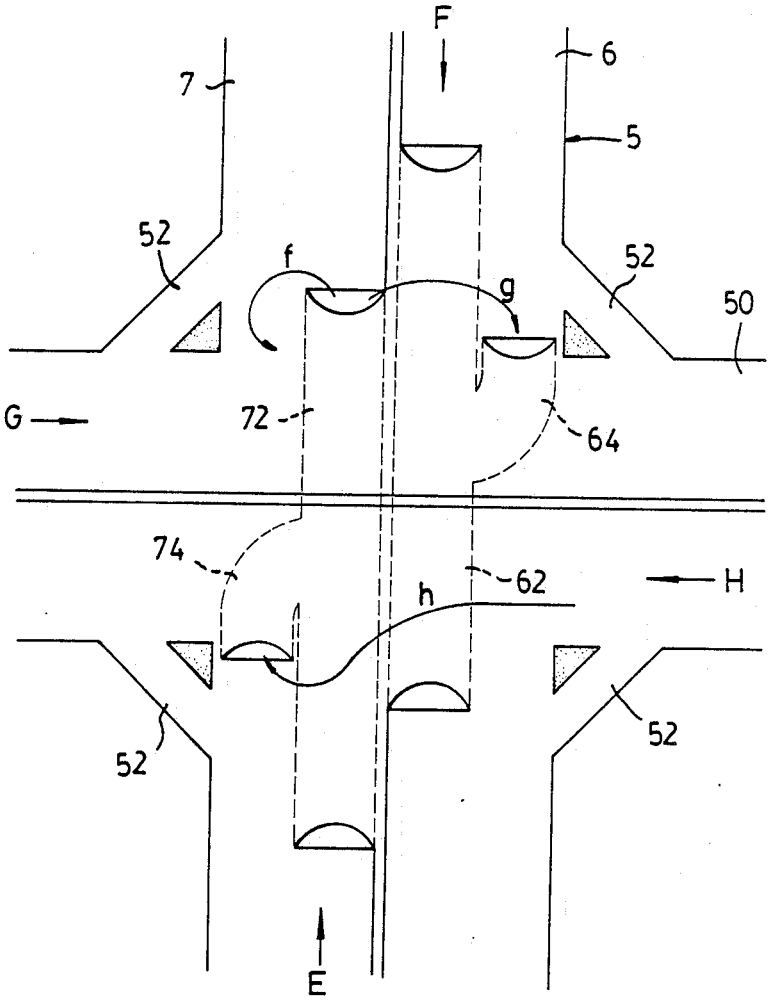
FIG. 3 is a top elevational view similar to FIG. 1, illustrating a further embodiment in accordance with the present invention.

If required in certain countries, slower vehicles, such as smaller motorcycles or bicycles can be separated from the faster vehicles. It is normally the case that the slower vehicles travel near the right shoulder of the right side of the road (for the crossroad system as shown in FIG. 1), or near the left shoulder of the left side of the road for the crossroad system as shown in FIG. 3. The crossroad for this type of traffic system is shown in FIG. 2. The crossroad is similar to that of FIG. 1 except that small tunnels 21, 31 are respectively provided beside the tunnels 22, 32. The entrances 211, 311 and the exits 210, 310 of the small tunnels 21, 31 are provided on the main road 1 and preferably positioned further from the level road 4 than the diagonal driveway 11 if one is used. The small tunnels 21, 31 start from their respective entrances 211, 311, run alongside the bypass tunnels 24, 34 and the tunnels 22, 32, and connect to the exits 210, 310. The entrances 421, 441 and the exits 420, 440 are provided on the main road 4. An approach 80 is provided under each driveway 11 to connect the corresponding entrance and exit. The approaches 82, 83 connect the entrance 421 and the exit 440 to the small tunnel 21 respectively and the approaches 92, 93 connect the entrance 441 and the exit 420 to the small tunnel 31 respectively. Approaches 81, 91 connect the entrance 421 with the exit 440, and the entrance 441 and the exit 420, respectively. The entrances 421, 441 and the exits 420, 440 are provided adjacent to the main road 1 and preferably beside the diagonal driveway 11 if any is provided.

Therefore, slower vehicle (M) can freely travel straight through along the small tunnel 21 and freely turn right either by the driveway 11 or by the approach 80 without interfering with the faster vehicles. The slower vehicle (N) can travel straight through along the roadway 42 or enter the entrance 421 and by following the arrow (m) either continue straight along the roadway 42 or follow the arrow (o) and merge with the approach 92 and leave through the exit 420. To turn right, the slower vehicle (N) can travel either along the driveway 11 or the approach 80 from the entrance 421 to the exit 210. To turn left, the slower vehicle (M) enters the entrance 211 and follows the arrow (m) to make a U-turn and merges into the roadway 42; from here, the slower vehicle (M) can travel either straight through along the roadway 42 or follow the arrow (o) to merge into the approach 92 and leave through the exit 420. To turn left, the slower vehicle (N) can enter the bypass tunnel 34 either directly by following the arrow (o) or by first entering the entrance 421, following the arrow (m) and then following the arrow (o). The vehicle (N) then merges into the small tunnel 31 and leave through the exit 310. To do a U-turn, the vehicle (M) follows the arrow (m) and the arrow (o) to merge into the opposite small tunnel 31. To do a U-turn, the vehicle (N) follows the arrow (o) and the arrow (n) to merge into the opposite roadway 44, or simply enters the entrance 421, follows the approach 81 and leaves through the exit 440. For the crossroad as shown in FIG. 2, slower vehicles may be required to make some turns, however it enables faster vehicles to move and turn freely without any interference and with greater safety.

In some countries, vehicles travel on the left side of the road. The crossroad for this type of traffic system is shown in FIG. 3. The configuration of the crossroad is similar to that of the crossroad in FIG. 1. The entrances and the exits of the tunnels 62, 72 are also arranged similar to that of the tunnels 22, 32. The vehicles (E, F, G, H) can freely drive straight through or can freely turn left on the driveways 52. To turn right, the vehicle (E) either follows the arrow (e) or the arrow (f) to merge into the main road 50; and the vehicle (H) follows the arrow (h) to enter the bypass tunnel 74 and merges into the tunnel 72. To do a U-turn, the vehicle (E) follows the arrow (g) to enter the bypass tunnel 64 and to merge into the tunnel 62; and the vehicle (H) follows the arrow (h) to enter the bypass tunnel 74, merges into tunnel 72 and follows the arrow (e) or arrow (f) to merge into the main road 50.

Alternatively, elevated roads or bridges (not shown) can be provided instead of the tunnels as illustrated in the drawings. In this case all the bypasses or the entrances and the exits of the tunnels can be suitably replaced by ramps with suitable slopes. The smaller tunnels can be replaced by suitable roadways for slower vehicles so that they will not interfere with the faster vehicles.

Accordingly, the crossroad in accordance with the present invention has the following advantages:

(a) The vehicles can freely travel straight through and freely turn without having to stop.

(b) No traffic lights are required.

(c) The drivers not only save time but also save money for fuel.

(d) The configuration of the crossroad in accordance with the present invention is simple and requires a relatively small area which reduces the construction cost thereof.

(e) Air pollution can be greatly diminished.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A crossroad comprising:

a first road being substantially level and straight;

a second road intersected with said first road;

a first pair of second dimensional passages being provided on said second road, each of said first passages having a bypass merging into one side thereof;

each of said first passages having a first entrance at one end and a first exit at the other end;

each of said first entrances being spaced further from said first road than said first exit on the same side of said first road;

each of said bypasses having an inlet adjacent to said first road and closer to said first road than said first exit on the same side of said first road;

wherein a vehicle driving into said first entrance and out of said first exit of one of said first passages is movable over said first entrance of the other said first passage for making a left turn, and movable into said inlet of said bypass of the other said first passage for making a U-turn.

2. A crossroad according to claim 1, further comprising:

a second passage on each side of said second road for slower vehicles;

each of said second passages having a second entrance and a second exit, with said second entrances being further from said first road than said first entrances on the same side of said first road, and said second exits being further from said first road than said first exits on the same side of said first road; and said second entrance of each of said second passages communicating with said first exit of a respective first passage.

3. A crossroad according to claim 2, further comprising:

a pair of third passages on said first road;

each of said third passages having a third entrance on one end and a third exit on the other end;

said third entrances communicating with said second exits of said second passages; and said second entrances communicating with said third exits of said third passages.

4. A crossroad according to claim 3, wherein an approach is provided on each side of said second road for connecting said third entrance with said third exit located on the same side of said second road.

* * * * *